US006505421B1

(12) United States Patent
Vaz

(10) Patent No.: US 6,505,421 B1
(45) Date of Patent: Jan. 14, 2003

(54) BLAST AND FRAGMENT RESISTENT POLYURETHANE BOOT SOLE FOR SAFETY FOOTWEAR

(75) Inventor: Guy Andrew Vaz, Singapore (SG)

(73) Assignee: BFR Holdings Limited, George Town (KY)

( * ) Notice: Subject to any disclaimer, the term of this patent is extended or adjusted under 35 U.S.C. 154(b) by 0 days.

(21) Appl. No.: 09/695,700

(22) Filed: Oct. 24, 2000

Related U.S. Application Data

(63) Continuation of application No. 08/894,895, filed on Aug. 28, 1997, now abandoned.

(30) Foreign Application Priority Data

Mar. 1, 1995 (SG) ..... 9500037

(51) Int. Cl.[7] ..... A43B 13/00; A43B 13/12; A43B 13/14

(52) U.S. Cl. ..... 36/30 R; 36/30 A; 36/31; 36/25 R

(58) Field of Search ..... 36/113, 115, 116, 36/7.5, 30 R, 30 A, 31, 25 R, 84; 139/420 A, 389

(56) References Cited

U.S. PATENT DOCUMENTS

| | | | | | |
|---|---|---|---|---|---|
| 4,155,180 | A | * | 5/1979 | Phillips | 36/103 |
| 4,526,828 | A | * | 7/1985 | Fogt et al. | 36/2 R |
| 4,649,586 | A | * | 3/1987 | Wu | 36/30 R |
| 5,277,966 | A | * | 1/1994 | Nakayama et al. | 139/389 |
| 5,285,583 | A | * | 2/1994 | Aleven | 36/44 |
| 5,390,430 | A | * | 2/1995 | Fitchmun et al. | 36/30 R |
| 5,401,564 | A | * | 3/1995 | Lee et al. | 139/420 A |
| 5,538,781 | A | * | 7/1996 | Rao et al. | 139/420 A |

* cited by examiner

*Primary Examiner*—Anthony D. Stashick
(74) *Attorney, Agent, or Firm*—Fox Rothschild O'Brien & Frankel LLP

(57) ABSTRACT

A blast and fragment resistant polyester or polyether-based polyurethane boot sole includes embedded protective material throughout the entire sole. The embedded protective material consists of one or more layers of woven polyaramid fibers. The polyaramid fibers are thinly coated with polyester or polyether-based polyurethane before they are woven into a layer for incorporation into the sole. This enhances the adhesion between the embedded polyaramid protective material and the polyurethane sole.

20 Claims, 4 Drawing Sheets

BLAST AND FRAGMENT RESISTENT POLYURETHANE BOOT SOLE FOR SAFETY FOOTWEAR

This application is a continuation of Ser. No. 08/894,895 filed Aug. 28, 1997, now abandoned which is a 371 of PCT/SG 96/00001 filed on Feb. 28, 1996.

FIELD OF THE INVENTION

The present invention relates to the construction of a boot sole, and more particularly pertains to a new and improved safety boot sole construction to prevent puncturing of the sole by high energy and high velocity projectiles thus affording greater protection to an individual's foot without over-restricting movement.

DESCRIPTION OF THE PRIOR ART

U.S. Pat. No. 5,237,758 to Zachman discloses semi-elliptical sections intersecting at loops with adjacent webs of adjacent loops intersecting with flexible rods directed through the intersecting loops to minimize lateral displacement of adjacent webs.

U.S. Pat. No. 5,285,583 to Aleven discloses a protective layer composed of plastic and including a flexible forepart portion having an insole board bonded to its bottom surface and a fabric liner bonded to its top surface during the process of moulding the protective plastic layer. The plastic used by Aleven is molten plastic injected in the final bonding process.

International Patent DE 4214802, by ZEPF H, to SPORTARTIKELFABRIK UHL GMBH KARL discloses a multi-layer boot sole having a walking surface, a damping intermediate sole, and an upper insole. The base is a thermoplastic moulding, or is made of metal, ceramic, or graphite, in which multi-filament organic or inorganic reinforcing fibres are embedded in the form of a mat, or woven or knitted into the structure. The elastic profiled portions are formed on the underside of the base by injection moulding or pressing. The base can contain only a single layer of woven fibres, its total thickness being approximately 0.5 mm.

Aleven achieved strength and impact resistance from a plastic plate in the sole, and the use of a fabric mesh was to reinforce the plastic and not to provide impact resistance. ZLPF H could only achieve a single layer of not more than 0.5 mm thickness of woven fibres through injection moulding or pressing. Aleven made no discussion of metal, ceramic, or graphite materials. So far, techniques to use aramid, ceramic, or graphite fibres in the construction of a boot sole in thickness to prevent puncturing of the sole by high energy and high velocity projectiles has not been mentioned or made feasible due to problems in rigidity and bonding.

SUMMARY OF THE INVENTION

The boot soles described in the prior art are insufficient against blast and projectile protection when it is desired to conserve toe-to-heel flexion in order to enable running, jumping, rope climbing, and to clear obstacles such as rope ladders and small steps, and with sufficient feel or sensitivity to detect edges, pits, and small stones. To attain this, the present invention provides a blast and fragment resistant polyester and/or polyether-based polyurethane boot sole comprising embedded protective material in which the material is embedded throughout the entire sole and is composed of at least one woven polyaramid (Kevlar) layer, the denisity of which is less than or equal to 15 oz per square yard. Increasing density and additional layers of woven polyaramid fibres increases the blast and fragment resistance.

It is also an object of the present invention to provide a boot sole with good adhesion between the various polyaramid (Kevlar) layers and/or graphite fibre bundles in spite of the poor intrinsic adhesion between the polyaramid fibres, graphite fibres, and the polyurethane. Due to the extremely thin coating of the various polyaramid (Kevlar) and/or graphite fibre bundles prior to weaving and/or due to the relatively loose or coarse weave of the polyaramid (Kevlar) fibres, the polyurethane is able to penetrate between the fibres, allowing the various layers to be well bonded together, thereby preventing the peeling apart of the sole in subsequent use.

Accordingly to the invention, polyaramid (Kevlar) and/or graphite fibres can be coated thinly with polyester or polyether-based polyurethane before they are woven into the required mat form. This will greatly improve adhesion between the polyaramid and polyurethane material .

Also according to the invention, polyester fibres, preferably poly(ethylene terephthalate) (PET) fibres, can be interwoven with or between the (coated or uncoated) polyaramid (Kevlar) fibres to improve adhesion between the polyaramid and polyurethane material.

Also according to the invention, carbon graphite fibres can be interwoven with or between the polyaramid (Kevlar) layers to further strengthen and to stiffen the sole.

Also according to the invention, a woven layer of mineral fibres, notably ceramic fibres or S-Glass fibres, can be included into the boot sole to act as a fire wall for protection against hot gasses with temperatures of between 815 and 1,650 degrees Celsius.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1-A is an enlarged view of the sole construction of FIG. 1;

FIG. 2-A is an enlarged view of the sole construction of FIG. 2;

FIG. 3-A is an enlarged view of the sole construction of FIG. 3;

FIG. 3-B is an enlarged view of an alternative sole construction to that depicted in FIG. 3-A;

FIG. 4-A is an enlarged view of the sole construction of FIG. 4; and

FIG. 4-B is an enlarged view of an alternative sole construction to that depicted in FIG. 4-A.

DESCRIPTION OF THE PREFERRED EMBODIMENTS

Figure 1:
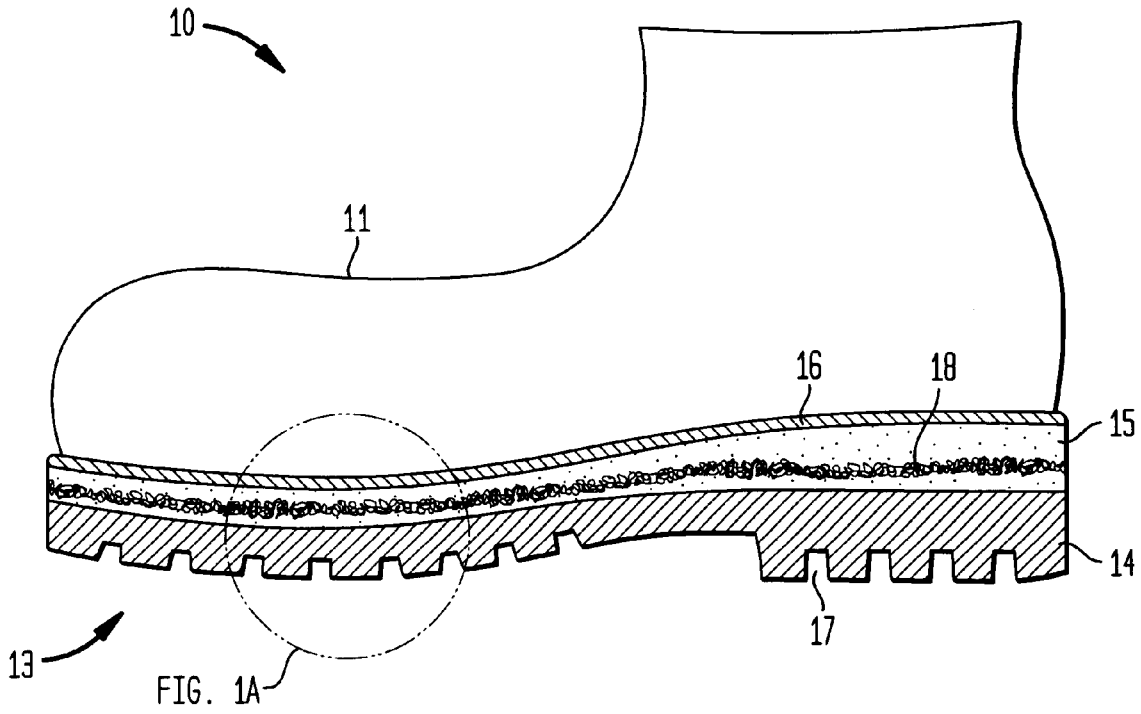
FIG. 1 is a vertical cross-sectional view of a boot having a first embodiment of the sole construction according to the present invention.
Figure 1A:
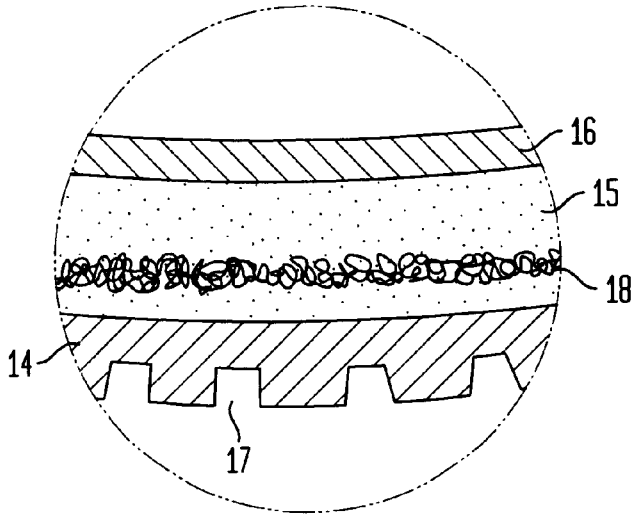

A boot having a first embodiment of the sole construction according to the present invention generally depicted as 10 in FIGS. 1 and 1-A.

The boot 10 has a standard shaped upper portion 11 and a composite sole 13. The composite sole 13 comprises an outer polyurethane sole 14 having a tread 17, an intermediate sole 15 into which is embedded a layer of polyaramid fibres 18, and optionally, an upper sole 16.

The composite safety boot sole is made in a traditional multi-stage mould which is commonly used in the polyurethane shoe soling industry.

The polyester and/or polyether-based polyurethane is first injected into a composite sole mould cavity to form the outer (lower) sole 14 such that its density is typically in the range of 500 to 2000 kg/m$^3$.

After removal of the top plate of the mould for the outer (lower) sole, one thick layer of polyaramid (Kevlar) woven fibre material 18 is placed onto the outer (lower) sole 14 which remains in the mould cavity.

The polyaramid (Kevlar) fibre material can be precoated with polyester and/or polyether-based polyurethane prior to weaving. The coat of polyurethane serves to facilitate good adhesion with and penetration by polyurethane which is injected into the mould cavity.

The density of the polyaramid layer 18 is at least 5 oz per square yard, preferably 15 oz per square yard, for each ply of woven polyaramid material.

This thick polyaramid layer 18 preferably consists of bundles of polyaramid in crowfoot or leno weave with 70% to 90% in the X to Y direction (that is perpendicular to toe-to-heel), and 10 to 30% in the toe-to-heel direction.

The thickness of the layer of the polyaramid layer 18 is at least 0.07 inches, more typically 0.11 inches, using Kevlar 49 in 7100 dernier bundles with tensile strength of 43,000 PSI and modulus 19 million PSI with a 0.07 inch diameter polyaramid fibres.

After placement of the polyaramid layer 18, polyester and/o)r polyether-based polyurethane is injected into the mould cavity containing the outer (lower) sole 14 at the base of the sole to form the intermediate sole 15. The polyurethane after injection into the mould has a typical density of <1000 kg/m$^3$ .

Due to the penetration of the polyurethane into and though the polyaramid layer 18 good adhesion is achieved between the outer (lower) arid sole 14 and intermediate sole 15, with the polyaramid layer 18 sandwiched in between.

At this stage, the upper portion 11 can be directly attached to the polyurethane composite sole 13 comprising the outer (lower) and intermediate soles 14, 15, or a third, upper sole 16 ran be added on top of the intermediate sole for enhanced comfort. In this latter case, the outer (lower) and intermediate soles 14, 15 as described above are left in the mould cavity, and polyester and/or polyether-based polyurethane is injected into the mould cavity, directly on top of the intermediate sole 15.

A shoe sole 13 made according to the above method with the preferred 15 oz per square yard polyaramid layer 18 is effective in providing blast and fragment resistance to a 60 grain projectile with a velocity of 1350 fps. It also conserves good toe-to-heel flexion in order to enable running, jumping, rope climbing, and to clear obstacles such as rope ladder and small steps, while avoiding delamination of the sole in subsequent use.

Figure 2:
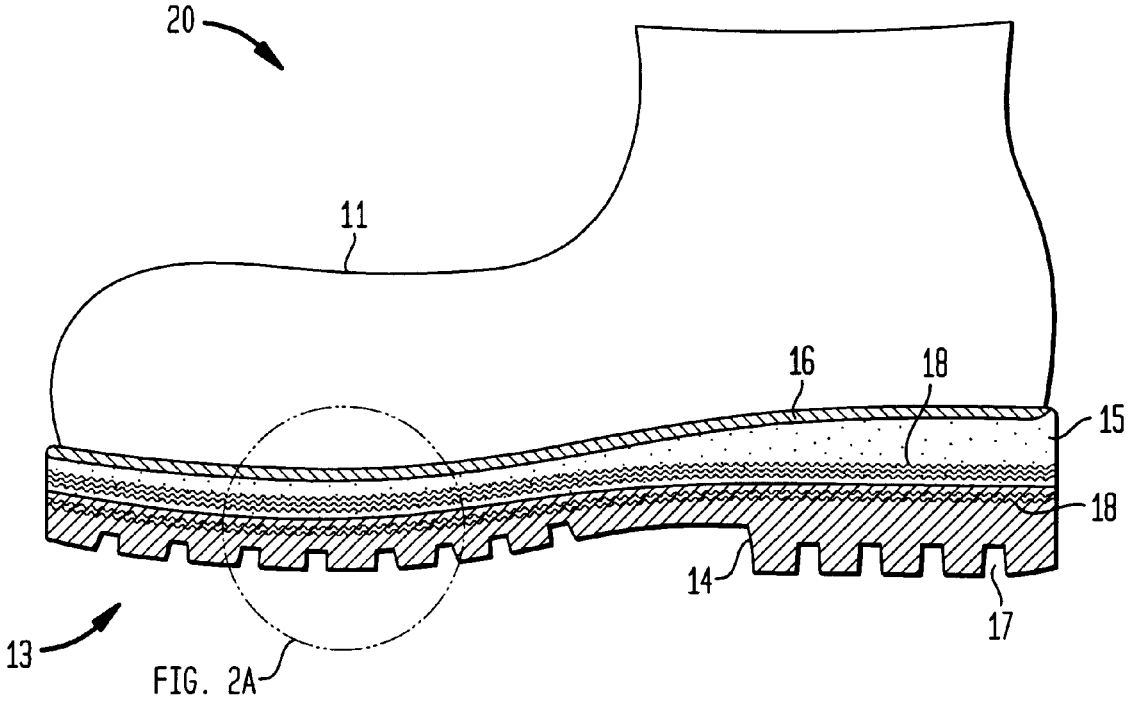
FIG. 2 is a vertical cross-sectional view of a boot having a second embodiment of die sole construction according to the present invention.
Figure 2A:
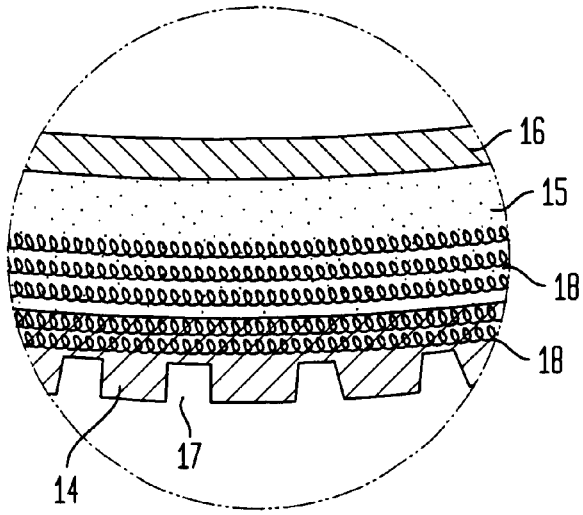

A boot having a second embodiment of the sole construction according to the present invention is depicted as 20 in FIGS. 2 and 2-A.

In this embodiment, where like features have the same reference number as used above, the sole 13 has further layers 18 of polyaramid fibre material incorporated therein.

As is depicted in FIG. 2-A, the outer sole 14 can have up to two layers of polyaramid fibre 18. The intermediate sole 15 would typically have between two to six layers of polyaramid fibre, with three layers being a typical number as is shown in FIG. 2-A.

To fabricate the sole, as depicted in FIGS. 2 and 2-A, 2 layers of the polyaramid woven layers 18 are placed into the mould cavity which forms the outer (lower) sole 14.

The polyaramid layers 18 consist preferably of polyaramid fibres being of 0.01 inch diameter. The fibres are woven together to form a layer less than 0.06 inches thick and, more typically, about 0.04 inches thick.

A polyester and/or polyether-based polyurethane is then injected into a composite shoe sole mould cavity to form the outer (lower) sole 14 such that its density is typically in the range of 500 to 2000 kg/m$^3$.

After removal of the top plate of the mould for the outer (lower;) sole 14, a further 2 to 6 layers of the same polyaramid (Kevlar) woven material 18 as embedded into the outer (lower) sole 14 are placed onto the outer (lower) sole 14 which remains in the base of the mould cavity.

At this stage a polyester and/or polyether-based polyurethane is injected into the mould cavity to form the intermediate sole 15 such that the polyurethane has a typical density of <1000 kg/m$^3$.

Due to the penetration of the polyurethane into and through the polyaramid layers 18 good adhesion is achieved between the outer (lower) and intermediate soles 14, 15 with the polyaramid layers 18 sandwiched in between.

At this stage, the upper portion 11 can be directly attached to die polyurethane composite sole 13 comprising of the outer (lower) and intermediate soles 14, 15, or a third, upper polyurethane sole 16 can be included for enhanced comfort. This is achieved by allowing the outer and intermediate soles (made by the process above) to remain in the mould cavity and by injecting polyester and/or polyether-based polyurethane onto the intermediate sole 15.

A shoe sole made according to the above method is even more effective in providing blast and fragment resistance than the first embodiment due to the multiple polyaramid layers.

In a third embodiment of this invention, the polyaramid layers 18 as described in relation to soles depicted in FIGS. 1 and 2 are interwoven with polyester (PET) fibres and the boot sole is made in the same manner as described above.

The use of interwoven polyaramid and polyester (PET) fibres has the advantage of further increasing the adhesion of the polyurethane material to the embedded layer(s) 18. This is due to the intrinsically superior adhesion between polyurethane and polyester.

In a fourth embodiment of this invention, the polyaramid layers 18 as described in the embodiments above are further interwoven with carbon graphite fibres having 12K TOW and a tensile strength of 470,000 PSI and modulus of 35 million PSI with the boot sole 13 being made in the same manner as described above.

The use of interwoven carbon graphite fibres has the advantage of further increasing strength and stiffness and of improving wear resistance.

Figure 3:
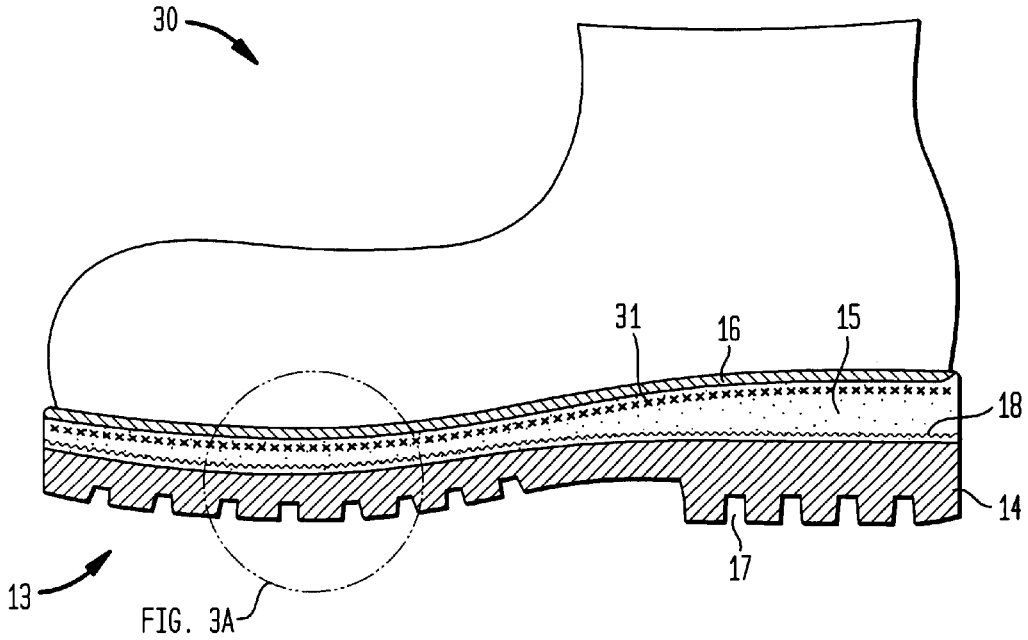
FIG. 3 is a vertical cross-sectional view of a boot having a third embodiment of the sole construction according to the present invention.
Figure 3A:
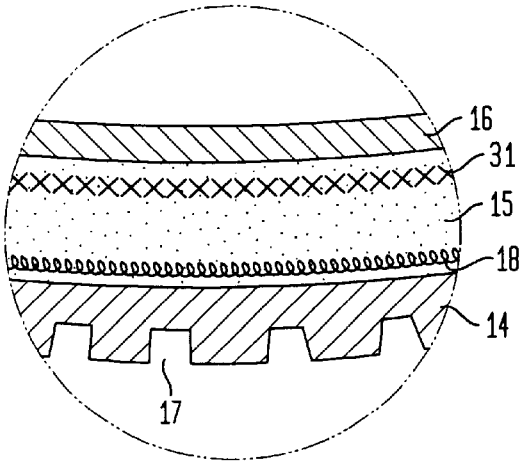
Figure 3B:
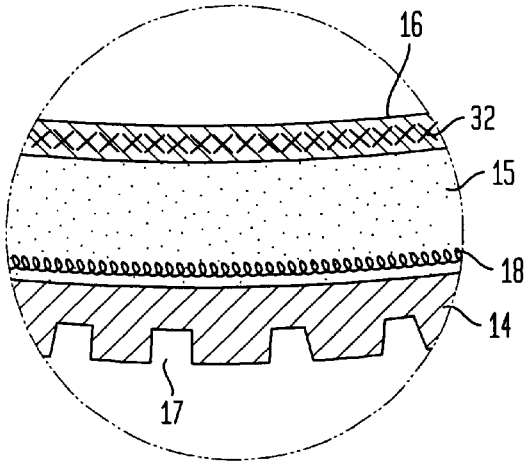

In a further embodiment of the invention depicted generally as 30 in FIGS. 3 and 3-A boot sole 13 is made as described above except that, in addition, a layer of woven ceramic fibres of composite ceramic/polyaramid fibres 31 is incorporated into the intermediate sole 15.

The woven ceramic fibre layer is preferably comprised of 0.05 inch diameter ceramic fibres with 70% to 90% of the ceramic fibres being woven into a crowfoot or leno weave in the X-Y direction (perpendicular to the toe-to-heel direction) and with 10% to 30% of ceramic fibres in the toe-to-heel direction. This layer is embedded in the intermediate sole above the polyaramid (Kevlar) layer(s) 18 (see FIG. 3-A). In an alternative arrangement, as depicted in FIG. 3-B, a thin (0.025 inch) composite layer 32 of ceramic/polyaramid fibres preferably consisting of standard bidirectional weave can be embedded in the upper sole 16.

The boot sole incorporating this composite layer of ceramic/polyaramid fibres 32 allows for protection against hot gasses, with a temperature resistance of 1,650 degrees Celsius during the very brief duration of the blast.

Figure 4:
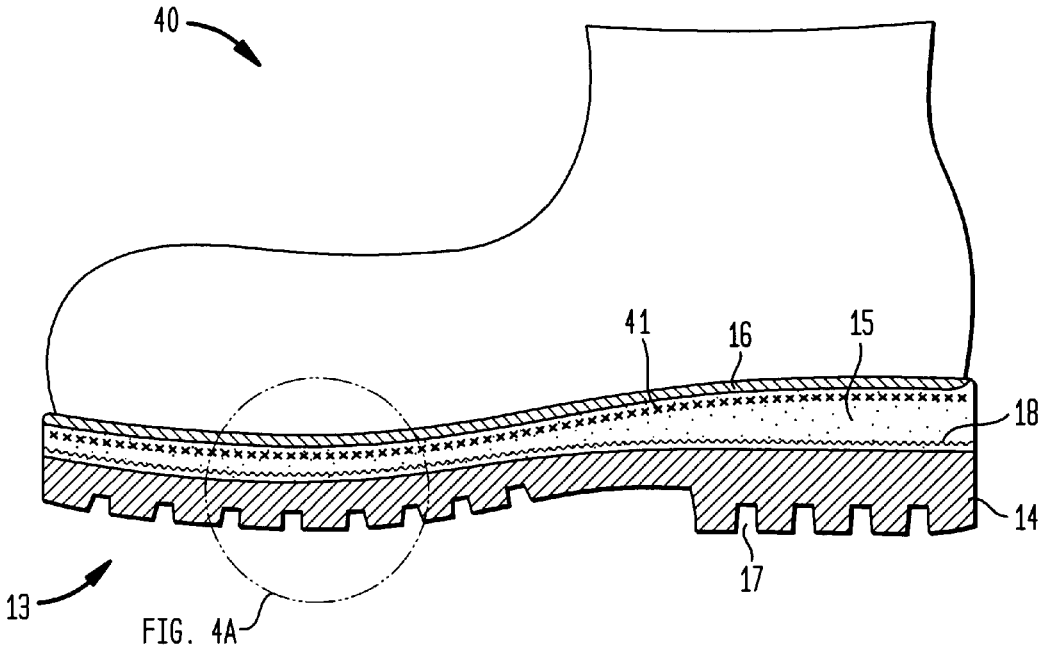
FIG. 4 is a vertical cross-sectional view of a boot having a fourth embodiment of the sole construction according to the present invention.
Figure 4A:
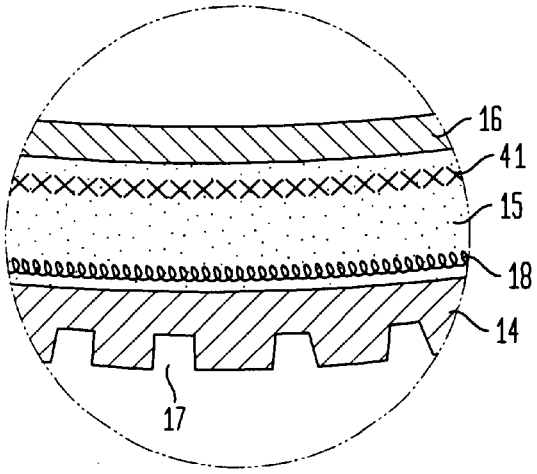
Figure 4B:
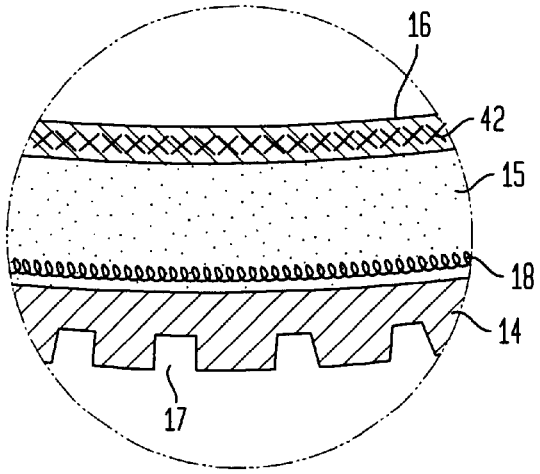

In a further embodiment 40 of this invention, a layer of composite S-Glass fibres can be added into the middle or upper sole 14, 15 (see FIGS. 5, 4-A and 4-B).

A layer 41 of 0.05 inch diameter ceramic fibres, where 70% to 90% of the S-Glass fibres are woven into a crowfoot or leno weave in the X-Y direction (perpendicular to the toe-to-heel direction) and with 10% to 30% of S-Glass fibres in the toe-to-heel direction, is embedded in the intermediate sole above the polyaramid (Kevlar) layer(s) 18 (FIG. 4-A). Alternatively, a thinner (0.025 inch) layer 42 of S-Glass fibres preferably having a standard bi-directional satin weave can be embedded in the upper sole 16 (FIG. 4-B).

The boot sole 13 incorporating the layer of S-Glass fibres 41, 42 allows for protection against hot gasses with a temperature resistance of 815 degrees Celsius for the very brief duration of the blast.

As to the manner of usage and operation of the instant invention, the same should be apparent from the above disclosure and accordingly no further discussion relative to the manner of usage and operation of the instant invention shall be provided.

With respect to the above description, it is to be realized that the optimum dimensional relationships and materials for the parts of the invention, to include variations in size, materials, shape, form, function, and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art it is not desired to limit the invention to, the exact construction and operation shown and described, and accordingly, all suitable modifications and equivalents which may be resorted to fall within the scope of the invention. :

What is claimed is:

1. A blast and fragment resistant boot sole comprising a molded polyurethane sole layer embedded with a protective material throughout the entire sole layer, said embedded protective layer comprising at least one layer of woven polyaramid fibres, wherein the density of each of said at least one layer of woven polyaramid fibres is equal to or less than 15 ounces per square yard and all polyaramid fibres within said at least one layer of woven polyaramid fibres are thinly coated with at least one of polyester-based polyurethane or polyether-based polyurethane.

2. The sole according to claim 1 wherein the embedded protective material comprises at least three polyaramid woven layers, the thickness of each layer being less than 0.06 inches, bonded together by polyurethane.

3. The sole according to claim 1 wherein the polyaramid fibres comprising each polyaramid layer are interwoven with polyester fibres.

4. The sole according to claim 1 wherein the polyaramid fibres comprising said at least one layer of woven polyaramid fibres are interwoven with carbon graphite fibres.

5. The sole according to claim 1 wherein the protective embedded material comprises at least one layer of carbon graphite fibres.

6. The sole according to claim 1 wherein the embedded protective material consists of one thick polyaramid woven layer, the thickness of which is at least 0.07 inches.

7. The sole according to claim 6 wherein the thick polyaramid layer consists of bundles of polyaramid in one of crowfoot and leno weave with 70% to 90% in an X-Y direction and 10% to 30% in a toe-to-heel direction.

8. The sole according to claim 1 wherein the protective embedded material comprises at least one layer of mineral fibres.

9. The sole according to claim 8 wherein the mineral fibres comprise one of the group of mineral fibres consisting of ceramic fibres and S-Glass fibres.

10. A blast and fragment resistant boot sole comprising a molded polyurethane sole with an embedded protective material throughout the entire sole, said embedded protective material including:

a plurality of layers of woven polyaramid fibers extending substantially throughout the sole, wherein the density of each of said plurality of layers of woven polyaramid fibers is equal to or less than 15 ounces per square yard, all polymaramid fibers within said plurality of layers of woven polyaramid fibers are thinly coated with at least one of polyester-based polyurethane or polyether-based polyurethane, and at least one of said plurality of layers of woven polyaramid fibers is a layer of inter-woven polyaramid and polyethylene terephthalate fibers; and at least one layer of woven mineral fibers extending substantially throughout the sole.

11. The sole of claim 10, wherein at least one of said plurality of layers of woven polyaramid fibers is a layer of inter-woven polyaramid and carbon graphite fibers.

12. A blast and fragment resistant boot sole comprising:

a first molded polyurethane sole having treads formed in a lower surface thereof;

a second molded polyurethane sole located on top of said first sole;

at least one layer of woven polyaramid fibers embedded within and extending substantially throughout said second molded polyurethane sole, wherein said boot sole is effective to provide blast and fragment resistance to 60 grain projectile with a velocity of 1350 fps.

13. The sole of claim 12, wherein said first sole and said second sole comprise polyester-based polyurethane.

14. The sole of claim 12, wherein said first sole and said second sole comprise polyether-based polyurethane.

15. The sole of claim 12, further comprising at least one layer of woven polyaramid fibers embedded in and extending substantially throughout said first sole.

16. The sole of claim 15, wherein at least one of said layers of woven polyaramid fibers extending substantially throughout said first sole and said second sole is a layer of inter-woven polyaramid and polyethylene terephthalate fibers.

17. The sole of claim 15, wherein at least one of said layers of woven polyaramid fibers extending substantially throughout said first sole and said second sole is a layer of inter-woven polyaramid and carbon graphite fibers.

18. The sole of claim 12, further comprising a third sole located on top of said second sole.

19. The sole of claim 18, further comprising a composite layer of woven polyaramid and ceramic fibers extending substantially throughout one of said second sole and said third sole.

20. The sole of claim 18, further comprising a composite layer of S-Glass fibers extending substantially throughout one of said second sole and said third sole.

* * * * *